US005852457A

United States Patent [19]

Kotaki et al.

[11] Patent Number: 5,852,457

[45] Date of Patent: Dec. 22, 1998

[54] INK CONTAINER CARTRIDGE

[75] Inventors: Yasuo Kotaki, Machida; Masanori Takenouchi, Yokohama; Hideo Saikawa, Machida; Hisashi Yamamoto, Hiratsuka; Yuji Hamasaki, Sagamihara, all of Japan

[73] Assignee: Canon Kabushiki Kaisha, Tokyo, Japan

[21] Appl. No.: 518,729

[22] Filed: Aug. 24, 1995

[30] Foreign Application Priority Data

Aug. 24, 1994 [JP] Japan ..... 6-199811
Aug. 22, 1995 [JP] Japan ..... 7-213290

[51] Int. Cl.[6] ..... B46J 2/175
[52] U.S. Cl. ..... 347/86
[58] Field of Search ..... 347/84–87

[56] References Cited

U.S. PATENT DOCUMENTS

| | | | |
|---|---|---|---|
| 4,771,295 | 9/1988 | Baker et al. . | |
| 5,155,502 | 10/1992 | Kimura et al. . | |
| 5,158,377 | 10/1992 | Suzuki et al. | 400/124 |
| 5,182,579 | 1/1993 | Haruta et al. . | |
| 5,237,342 | 8/1993 | Saikawa et al. . | |
| 5,319,841 | 6/1994 | Yata et al. | 29/451 |
| 5,365,262 | 11/1994 | Hattori et al. | 347/87 |
| 5,430,471 | 7/1995 | Nakajima et al. | 347/87 |
| 5,557,310 | 9/1996 | Kurata et al. | 347/87 |
| 5,567,373 | 10/1996 | Sato et al. | 264/112 |
| 5,587,731 | 12/1996 | Yasunaga et al. | 347/86 |

FOREIGN PATENT DOCUMENTS

| | | | |
|---|---|---|---|
| 0419192 | 3/1991 | European Pat. Off. | B41J 2/175 |
| 0466142 | 7/1991 | European Pat. Off. | B41J 2/175 |
| 63-003959 | 1/1988 | Japan | B41J 3/04 |
| 5038816 | 2/1993 | Japan | B41J 2/175 |
| 5-104735 | 4/1993 | Japan | B41J 2/175 |
| 5-345420 | 12/1993 | Japan | B41J 2/175 |
| 6015845 | 1/1994 | Japan | B41J 2/175 |
| 6099585 | 4/1994 | Japan | B41J 2/175 |

*Primary Examiner*—N. Le
*Assistant Examiner*—Judy Nguyen
*Attorney, Agent, or Firm*—Fitzpatrick, Cella, Harper & Scinto

[57] ABSTRACT

An ink container cartridge detachably mountable to an ink jet recording head, includes a main body of ink container cartridge; an ink retaining member, in the main body, for retaining the ink; wherein the ink retaining member is contained in the ink container cartridge so that a compression ratio A of the ink retaining member by a side having an ink supply opening of the ink container cartridge and a side opposite therefrom, and a compression ratio B by other two opposite sides thereof, satisfy A>B, and $1.1 \leqq A \leqq 1.6$.

8 Claims, 6 Drawing Sheets

INK CONTAINER CARTRIDGE

FIELD OF THE INVENTION AND RELATED ART

The present invention relates to an ink container which is detachably mountable relative to an ink jet recording head and which contains ink to be supplied to the ink jet recording head for effecting recording by ejecting the ink onto a recording material, and more particularly to an ink container having therein an ink absorbing material.

Recently, note type or lap-top type personal computer or word processor which are small in size and light in weight and therefore which are excellent in portability, have become widely used. Correspondingly, a small printer is demanded. For such a small printer, a proposal has been made, wherein an ink container is integral with a recording head, and when the ink is used up, the ink container and the ink jet cartridge are all integrally replaced. However, such an ink jet cartridge is replaced together with the recording head which is expensive, than the ink container, and therefore, the cost-performance is not good. In view of this, a head cartridge and an ink container cartridge, have been proposed in which the ink container and the recording head are separable. Typical examples will be described.

A first example is disclosed in Japanese Laid Open Patent Application No. SHO-63-3959, wherein the ink is contained in an ink container bladder in the ink container cartridge. For the purpose of prevention of ink leakage, the ink container opening portion namely ink supply opening is sealed by a sealing film member which is pierced by an ink supply tube upon the start of use.

In a second example, disclosed in Japanese Laid Open Patent Application NO. HEI-5-345420, an ink container cartridge separate from an ink jet head has a sponge for retaining the ink. When the ink jet head and container are connected with each other, the supply tube presses the sponge to increase the capillary force of the sponge adjacent the ink supply tube, thus concentrating the ink to the neighborhood of the supply tube, by which the stable ink supply to the ink jet head can be accomplished.

In this separable-exchangeable type ink cartridge, only the ink container can be replaced when the ink is used up, and therefore, the cost performance has been drastically improved. However, the separable type gives rise to a problem.

For example, in the case of Japanese Laid Open Patent Application No. SHO-63-3959, the ink container bladder is used to contain the ink. If the user removes the present cartridge before using up the ink in the ink container cartridge, the ink in the ink container bladder is opened to the ambience since the sealing film member has been opened. If this is done, the ink leakage may occur through the ink supply opening when the ink container cartridge is removed. In order to avoid the problem, it would be considered to provide a valve at the opening portion. However, this results in cost increase, and the advantage of separable type is not available.

In the case of Japanese Laid Open Patent Application No. HEI-5-345420, the accommodation of the ink is achieved by the sponge in the cartridge, and therefore, even if the ink container is removed before the ink is used up, the ink does not leak out because the capillary force of the sponge retains the ink therein. However, the sponge exists substantially uniformly in the ink container cartridge. The ink supply is stabilized by increasing the capillary force by the ink supply tube of the ink jet head pressing the sponge, thus concentrating the ink to the neighborhood of the supply tube. Therefore, when the ink container cartridge is removed in the middle of use, the sponge restores to the initial state with the result that the capillary force becomes uniform, and therefore, the ink no longer concentrates adjacent the supply opening. If the ink in the neighborhood of the opening portion is evaporated, the ink is concentrated to the central portion of the sponge. If this occurs, the ink will not become concentrated to the neighborhood of the supply tube even if the capillary force there is increased by pressing it to the sponge. Then, the remaining ink is not usable, with the result of increase of running cost.

For the purpose of prevention of this problem, Japanese Laid Open Patent Application No. HEI-5-104735 has proposed that the cartridge is constituted by an ink maintaining member such as sponge, and a connection member for stable supply of the ink from the ink maintaining member to the ink supply tube. With this structure, the ink cutting due to the remounting of the ink container, and the cost increase of the ink container cartridge alone can be minimized. However, with this type, it is required that the ink maintaining member and the connection member are contacted with each other. In the case of the ink cartridge using the sponge, for example, the sponge deforms by the creep deformation depending on the condition of the keeping if it is kept out of use. If such an ink container cartridge receives external shock, the sponge yields in the direction of the shock. Even if the elasticity of the sponge remains, the sponge does not restore from the position to which it is moved by the yielding, unless the restoring force exceeds the friction resistance force between the absorbing material and the internal wall surface of the ink container. In the worst case, the contact state between connection member and ink maintaining member is not kept with the result of separation therebetween. If the filling amount of ink is increased in an attempt to decrease the running cost of the ink container, the shock force and the degree of yielding is likely to increase to promote the separation between the connection member and the ink maintaining member.

If the separation occurs, the ink communication therebetween is cut with the result of incapability of recording operation.

SUMMARY OF THE INVENTION

Accordingly, it is a principal object of the present invention to provide an ink container cartridge capable of stably supplying the ink to a recording head despite ambience charge and keeping condition. It is another object of the present invention to provide a separable type ink container cartridge wherein the ink can be stably supplied even if the ink container cartridge is demounted from a recording head during use thereof and then it is mounted.

According to an aspect of the present invention, there is provided an ink container cartridge detachably mountable to an ink jet recording head, comprising: a main body of ink container cartridge; an ink retaining member, in said main body, for retaining the ink; wherein said ink retaining member is contained in said ink container cartridge so that a compression ratio A of said ink retaining member by a side having an ink supply opening of said ink container cartridge and a side opposite therefrom, and a compression ratio B by other two opposite sides thereof, satisfy $A>B$, and $1.1 \leqq A \leqq 1.6$.

According to another aspect of the present invention, there is provided an ink container cartridge detachably mountable relative to an ink jet recording head, comprising:

a main body; an ink retaining member, in said main body, for retaining ink; wherein stress T of said ink retaining member pressing to a surface having an ink supply opening and a surface opposite therefrom, and a stress S pressing to two other internal wall of said ink cartridge, satisfy T>S, and $1.1 \leqq T \leqq 1.6$.

According to a further aspect of the present invention, there is provided an ink container cartridge detachably relative to an ink jet recording head, comprising: a main body; an ink retaining member, in said main body, for retaining ink; wherein a deformation amount M of said ink retaining member between a side having a supply opening and a side opposite therefrom between before it is taking out of said cartridge and after it is taking out, and a deformation amount N between two sides perpendicular thereto therebetween, satisfy M>N, and $1.1 \leqq M \leqq 1.6$.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 8, (B) shows an ink retaining member according to a fourth embodiment of the present invention before insertion of the ink container.

FIG. 9, (B) show an ink retaining member of a fifth embodiment of the present invention before ink container insertion.

FIG. 10, (B) shows an ink retaining member according to a sixth embodiment of the present invention, after it is taken out of the ink container.

DESCRIPTION OF THE PREFERRED EMBODIMENT

[Embodiment 1]

Figure 1:
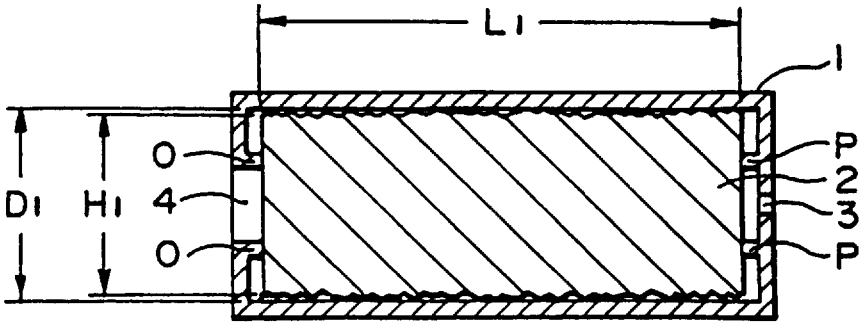
FIG. 1 is a sectional view of an ink container cartridge according to a first embodiment of the present invention.
Figure 2:
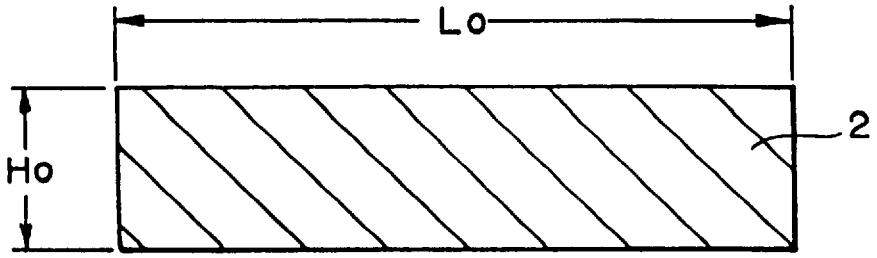
FIG. 2 shows an ink retaining member according to the first embodiment before accommodation.

FIG. 1 is a sectional view of an ink container cartridge to which the present invention is applicable. As shown in FIG. 1, a generally hexahedron ink container 1 contains therein a compressed ink retaining member 2. The ink retaining member 2 is compressed to a length $L_1$ by an end surface of a rib O at an opening portion 4 for insertion of ink jet head supply tube and an end surface of a cap rib P disposed around the air vent 3. Without any external force, the ink retaining member 2 has a rectangular parallelopiped shape having a length $L_0$ and a width $H_0$, as shown in FIG. 2. In this embodiment, the ink retaining member 2 satisfies $L_0>L_1$, and $H_0>H_3$. The ink retaining member 2 is compressed between the surface having the ink supply opening and the surface faced thereto at a compression ration $L_1/L_0$ [A]=A, and it is compressed between the other facing surfaces at compression ratio $H_1/H_0$=B.

The ink retaining member 2 used in this embodiment 1 is of foamed polyurethane resin material, and the above compression ratios A are determined so as to provide proper sizes of cells for the desired negative pressure, and varies depending on the number of cells per unit length and the length $L_0$ before the compression.

Various samples of the ink container cartridges were produced with different combinations of compression ratios A and compression ratios B. The ink was filled into the samples, and they were kept under 60° C. for one month. Then, they were dropped from the height 90 cm on lauan material with the side opposite from the one having the ink supply port downward. The positional deviations of the inside absorbing material occurred were given on the table.

TABLE 1

| | A | | | | | |
|---|---|---|---|---|---|---|
| B | 1.0 | 1.1 | 1.2 | 1.4 | 1.6 | 1.8 |
| 0.9 | NG | G | G | G | F | NG |
| 1.0 | G | E | E | E | G | F |
| 1.1 | F | E | E | E | E | G |
| 1.2 | F | G | G | E | G | F |
| 1.3 | NG | G | E | E | G | NG |
| 1.4 | F | G | G | G | G | NG |
| 1.5 | NG | F | F | F | F | NG |

In the Table, "A" is the compression ratio of the ink retaining member between the surface having the ink supply opening and the surface faced thereto of the ink container cartridge.

"B" is a compression ratio of the ink retaining member between two surfaces in a direction perpendicular to the direction in the "A".

"Excellent" means that no deviation of the inside ink retaining member is observed for all of 5 samples.

"Good" means that although the deviation is absorbed in 1–2 samples out of 5 samples, but the ink supply performance is not practically influenced.

"Fair" means that although the deviation is absorbed in 2–3 samples out of 5 samples, but the ink supply performance is not practically influenced.

"No Good" means that the deviation is absorbed in 3–5 samples out of 5 samples, and the ink supply performance is deteriorated.

As will be understood from Table 1, the satisfactory properties are provided when the compression ratio A and compression ratio B satisfy A>B, and compression ratio A is in the range of 1.1–1.6, and compression ratio B is in the range of 1.0–1.4.

Further preferably, compression ratio A=1.1–1.4 and compression ratio B=1.0–1.2.

If the compression ratio of the ink retaining ember is too large, it is creased when it is inserted into the ink container cartridge, with the result that it is not uniformly packed therein. If the compression ratio is too small, it may be easily moved by shock, or it may be easily yielded.

Particularly, if the compression ratio B is smaller than 1.0, a gap is formed between the ink container cartridge and the ink retaining member, and it may be oblique upon high compression filling of the ink retaining member.

Five samples were produced with the combinations of compression ratio A=1.1, 1.2, 1.4, 1.6, and Compression ratio B=1.0, 1.1, 1.2, 1.3, 1.4.

They were mounted and demounted repeatedly 10 times, and thereafter, the state of the ink retaining member at the ink supply opening portion was observed. Then, the ink container cartridge is mounted to the apparatus, and the printing operation was carried out. The results are shown in Table 2.

TABLE 2

| | A | | | |
|---|---|---|---|---|
| B | 1.0 | 1.2 | 1.4 | 1.6 |
| 1.0 | E | E | E | G |
| 1.1 | E | E | E | G |
| 1.2 | G | E | E | G |
| 1.3 | F | G | G | F |
| 1.4 | F | F | F | F |

"Excellent" means that the ink retaining member was restored to the ink supply opening portion after the ten times mounting and demounting operations.

"Good" means that the ink retaining member was not sufficiently restored to the ink supply opening portion in only 1–2 samples, but the printing operation was not influenced.

"Fair" means that the ink retaining member was not restored to the ink supply opening portion after the 10 times mounting and demounting, and the printing operations were not satisfactory.

From overall evaluations, it is desirable in the usual conditions that the compression ratios A and B satisfy A>B.

And in addition the compression ratios satisfy A=1.1–1.6, B=1.0–1.4, further preferably, A=1.1–1.4, B=1.0–1.2. With these conditions, the ink container cartridge is sufficiently practically usable even after several mounting-and-demounting operations are repeated.

[Embodiment 2]

Figure 3:
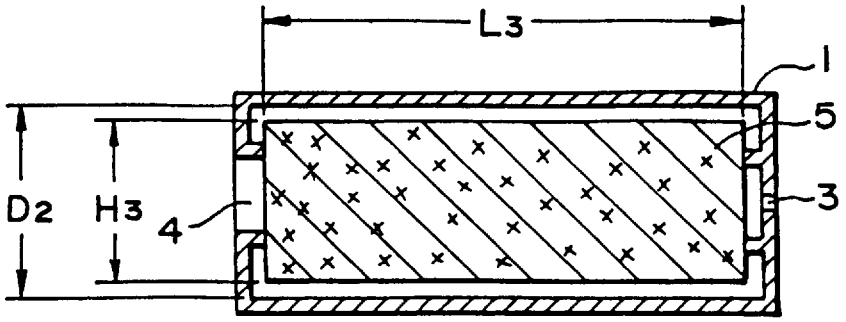
FIG. 3 is a sectional view of an ink container cartridge according to a second embodiment of the present invention.
Figure 4:
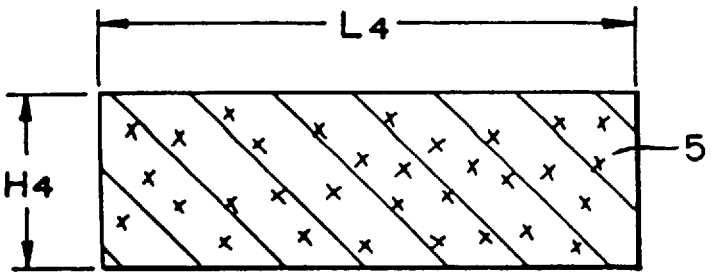
FIG. 4 shows an ink retaining member according to a second embodiment before accommodation.

FIG. 3 shows embodiment 2, wherein the ink retaining member to be inserted into the ink container cartridge is shaped by heat-pressing quite into conformity with the shape after being inserted into the ink container cartridge (compressed absorbing material).

It has been confirmed that the heat compression member of this embodiment is satisfactory without yielding in the impact test, and the satisfactory ink supply performance can be assured, as long as the above-described conditions are satisfied.

In this embodiment, the use is made with the absorbing material which is heat-pressed at the four sides except for the two sides having the opening portion 4 and the air vent 3. However, the pressing may be imparted to any sides as long as the cell size after the compression is proper to provide the desired negative pressure, and the configuration does not restore to that before the heat-pressing. Since, however, the portion of the ink retaining member directly pressed is heat-cured, heat-pressing on the side not faced in the ink supply direction is preferable.

With this embodiment, the difficulty in the packing of the ink retaining member during the manufacturing of the ink container, can be eased, so that the stable manufacturing is accomplished.

[Embodiment 3]

Figure 5:
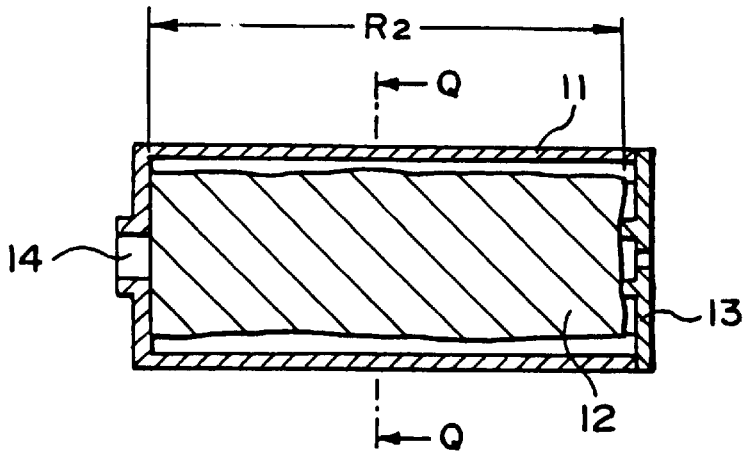
FIG. 5 is a sectional view of an ink container cartridge according to a third embodiment of the present invention.

FIG. 5 is a sectional view of an ink container cartridge according to another embodiment, wherein reference numeral 11 designates an ink container, into which an ink retaining member 12 is packed with compression. A container cap 13 is bonded by ultrasonic fusing thereafter. Designated by 14 is an ink supply opening for supplying the ink to the recording head.

Figure 6A:
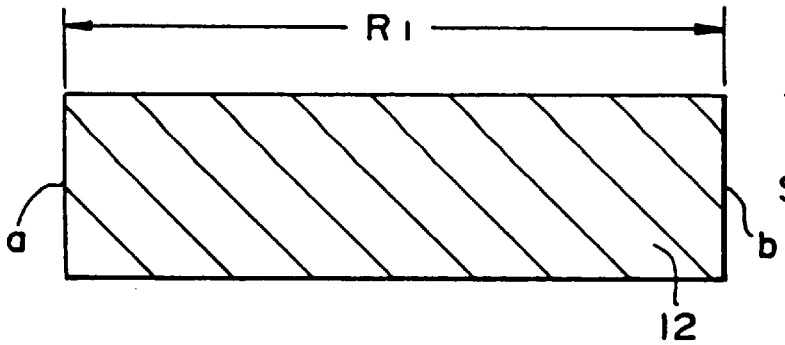
FIGS. 6(A) and 6(B) show an ink retaining member according to the third embodiment of the present invention before insertion of an ink container.
Figure 6B:
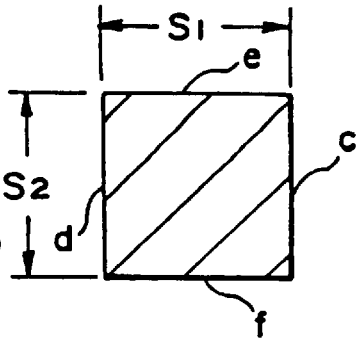

FIG. 6 shows dimensions before compression insertion of the ink retaining member 12 into the ink container 11. In this embodiment, dimension S1=25 mm between surfaces c–d, and dimension S2=25 mm between surfaces e–f, and dimension R1=85 mm between surfaces a–b.

Figure 7:
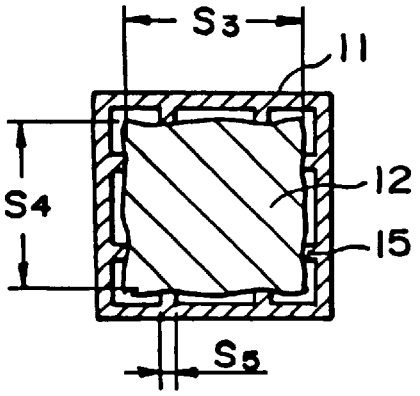
FIG. 7 is a sectional view taken along a line QQ of FIG. 5.

FIG. 7 is a sectional view taken along QQ in FIG. 5. Designated by 15 is a rib provided on the ink container 11. On this sectional view, only the portion of the rib 15 is contacted to the ink retaining member 12. The ink container 11 is of modified PPO, and ink retaining member 12 is of foamed urethane resin material.

The rib 15 has a width of approx. 1.5 mm, and the section of the ink retaining member 12 after insertion has the dimensions of S3=22 mm, S4=22 mm, and R2=61 mm (see FIG. 5). The ink retaining member 12 is compressed and inserted into the ink container 11, so that it is compressed at the ratio of 1.4 (85/61 (mm)) in the ink supply direction, and is compressed at the ratio of 1.1 (25/22 (mm)) in the directions orthogonal thereto. As described in embodiment 1, the compression ratio of the ink retaining member 12 in the ink supply opening direction is larger than that in the other directions, and therefore, the ink retaining member 11 does not separate from the ink supply opening 14 even upon impact thereto.

The object of the present invention is further assured by the above-described structure. The provision of the rib 15 for the ink container 11 is effective to decrease the area in which the ink retaining member 12 is contacted to the internal wall of the ink retaining member 12. Therefore, the friction resistance in the direction along the side surface of the ink retaining member 12 is decreased. Since the frictional force along the side wall upon the falling impact in the direction perpendicular to the ink supply surface is reduced, the repelling force of the ink retaining member in the direction of the impact is hardly affected. Therefore, even upon external shock which displaces ink retaining member 12 from ink supply opening 14, the ink retaining member assuredly restores itself to its original state, thus further assuring the ink supply performance of the ink cartridge.

The inventors have found that if the contact ratio between the internal wall of the ink container and the side surface of the ink retaining member 12 (the surfaces perpendicular to the ink supply direction), is not more than 15%, the ink supply performance of the ink cartridge can be assured even if it is subjected to falling impact, or if it is kept out of use for a long term.

[Embodiment 4]

Figure 8A:
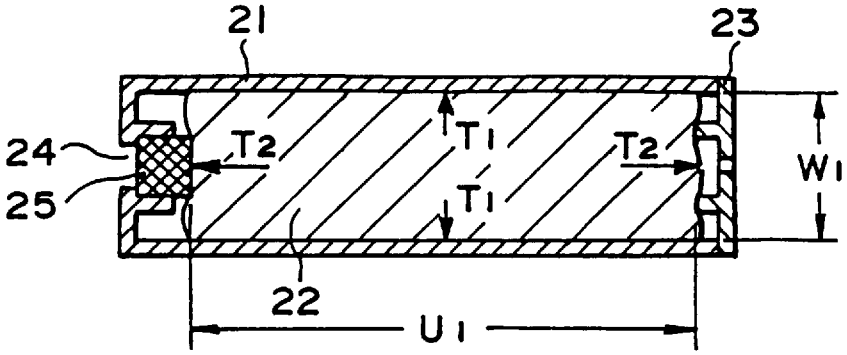
FIG. 8, (A) is a sectional view of an ink container cartridge according to a fourth embodiment of the present invention.

FIG. 8(A) is a sectional view of an ink cartridge according to a further embodiment. In FIG. 8(A), ink retaining member 22 is compressed and inserted into the ink container 21. Designated by 24 is an ink supply opening for supplying the ink to the head. The ink retaining member 22 is compressed by an ink container cap 23 and a connection member 25 comprising a material having a high ink retaining property, and are balanced by the stress T2. In the direction perpendicular to the direction of the stress T2, the ink retaining member 22 is compressed by the internal wall of the ink container 21, and balance is provided by the stress T1. The ink container 21 is of modified PPO, and the ink retaining member 22 is of foamed urethane resin material. The compressed dimensions of ink retaining member 22, as defined by the internal walls of ink container 21, are U1=65 mm, and W1=20 mm.

Figure 8B:
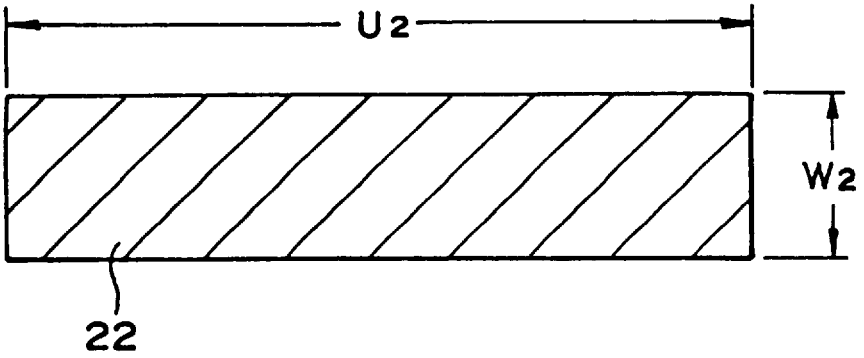

FIG. 8(B) shows the state of said ink retaining member 22 before insertion into the ink container 21. A dimension U2 before insertion, corresponding to U1, is U2=85 mm, and the dimension W2 before insertion is 22 mm. Therefore, the compression ratios are 1.3 and 1.1, respectively. If the foamed urethane resin material of the ink retaining member does not exhibit anisotropy relative to the compression stress, the repelling stresses are proportional to the compression ratios, and $$T2>T1$$

Therefore, even if the ink retaining member 22 is instantaneously separated from the connection member 25 due to impact such as falling in the direction perpendicular to the ink supply surface, the repelling force of the ink retaining member in the ink supply surface direction exceeds the frictional force along the side surface direction, because the stress T1 in the side surface direction is smaller than the stress T2 in the ink supply surface direction. Therefore, the ink retaining member 22 is recontacted to the connection member 25. Therefore, the ink supply performance of the ink cartridge is not deteriorated. The preferable ranges of the compression ratios A and B as in embodiment 1, applies to this embodiment with respect to the repelling stress.

Therefore, the repelling stress T2 is 1.1–1.6, preferably, 1.1–1.4, and the repelling stress T1 is 1.0–1.4, preferably, 1.0–1.2.

In the example of FIG. 8, the foamed urethane resin material of the ink retaining member does not have anisotropy relative to the compression stress. If the foamed urethane resin material is heat-pressed in the T3 direction after having been formed, as in FIG. 9(A), anisotropy results relative to the compression stress between the T3 direction and T4 direction. In such a case, even if the compression ratio upon the insertion of the ink retaining member 32 into the ink container is the same, the repelling stress may be different. The connection member 25 is preferably contacted at the supply opening side with not less than approx. 50% area. If it is smaller than 50%, the contact area is too small with the result of larger contact stress, and the ink retaining member 32 is relatively easily deformed by the connection member 35.

If it is larger than 50%, the contact stress is sufficiently dispersed, and therefore, deformation does not easily result, and the supply performance can be assured.

[Embodiment 5]

Figure 9A:
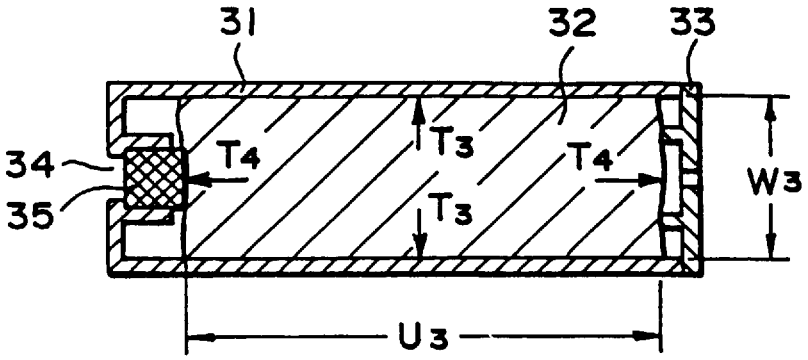
FIG. 9, (A) is a sectional view of an ink container cartridge according to a fifth embodiment of the present invention.
Figure 9B:
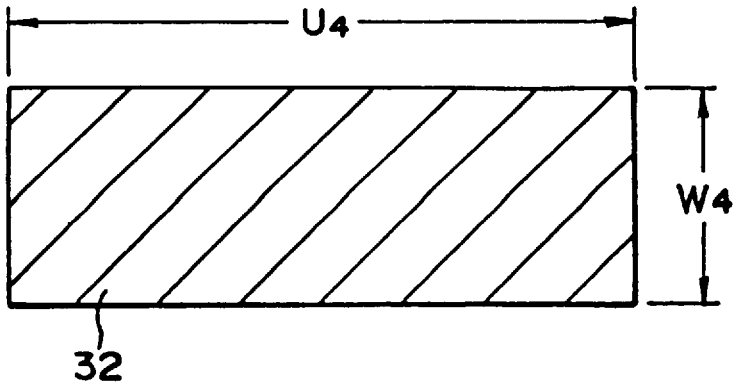

In FIG. 9(A), the compressed dimensions of ink retaining member 32, as defined by the internal walls of ink container 31 U5 and W5 (FIG. 9(B) shows the ink retaining member 32 before insertion into ink container 31. The dimension U4 before insertion, corresponding to U3, U4=80 mm, and the dimension W4 before insertion corresponding to W3, W4=29 mm. Therefore, the compression ratios are both 1.3. However, because of anisotropy in the T3 direction and T4 direction, the repelling stress is 6N in the T3 direction and 10N in the T4 direction, and therefore, $$T4>T3$$

Therefore, even if the ink retaining member 32 is instantaneously separated from the connection member 35 due to impact such as falling in the direction perpendicular to the ink supply surface, the repelling force of the ink retaining member in the ink supply surface direction exceeds the frictional force along the side surface direction, because the stress T3 in the side surface direction is smaller than the stress T4 in the ink supply surface direction. Therefore, the ink retaining member 32 is recontacted to the connection member 35. Therefore, the ink supply performance of the ink cartridge is not deteriorated.

[Embodiment 6]

Figure 10A:
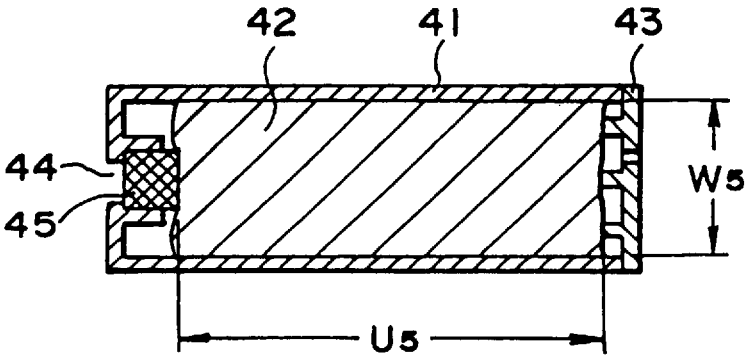
FIG. 10, (A) is a sectional view of an ink container cartridge according to a sixth embodiment of the present invention.
Figure 10B:
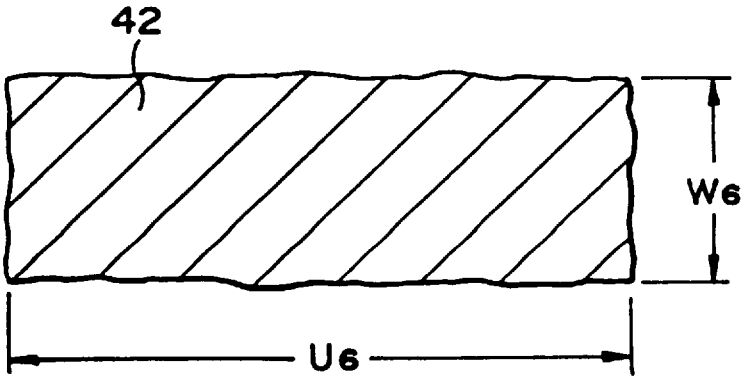

FIG. 10(A) is a sectional view of an ink cartridge according to a further embodiment. In FIG. 10(A), the ink retaining member 42 is compressed and inserted into the ink container 41. The ink retaining member 42 is compressed by the ink container cap 43 and connection member 45 inserted into the supply opening 44 for supplying the ink. The compressed dimensions of ink retaining member 42, as defined by the dimensions of ink container 41 are U5=55 mm and W5=21 mm. FIG. 10(B) shows a state wherein the ink retaining member 42 is taken out of the ink container 41, and it is cleaned to remove the ink, and then it is dried. The dimension U6 after it is taken out (corresponding to U5) V6=70 mm, and the dimension W6 after it is taken out (corresponding to W5) is W6=28 mm. By taking the ink supply member 42 out of the ink container 41, it expands by 15 mm in the supply opening direction, and 7 mm in the right angle direction. The deformation amount M (=15 mm) of the ink retaining member 42 in the supply opening direction and the deformation amount N (=7 mm) in the direction perpendicular to the supply opening direction, satisfy:

$$M>N$$

Therefore, the repelling force of the ink retaining member in the supply opening direction exceeds the frictional force along the direction of the side surface. Therefore, even if the ink retaining member 42 is instantaneously separated from the connection member 45, the repelling force of the ink retaining member in the supply opening direction exceeds the frictional force along the direction of the side surface, and therefore, the ink retaining member 42 is recontacted to the connection member 45. Accordingly, the supply performance for the ink is not deteriorated.

As regards the deformations M and N, the measurements were made for the samples used in embodiment 1. It has been found that the samples they exhibited good ink supply performance, also exhibited good restoration to their original state after being taken out. Therefore, the preferable ranges are:

Deformation ratio in direction $M$=1.1–1.6, preferably 1.1–1.4; and

Deformation ratio in direction N=1.0–1.4, preferably 1.0–1.2.

Generally, foamed urethane resin material or the like deforms only at the position where it is to be connected with the ink supply opening, and therefore, it is not completely restored even if it is taken out of the ink container, in some cases. Even in such a case, the supply performance is sufficiently assured, if the value range of embodiment 5 is satisfied, since then the marginal portions have sufficient restoration power.

While the invention has been described with reference to the structures disclosed herein, it is not confined to the details set forth and this application is intended to cover such modifications or changes as may come within the purpose of the improvements or the scope of the following claims.

What is claimed is:

1. An ink container detachably mountable to an ink jet recording head, comprising:

a substantially hexahedron casing having a first pair of opposed sides and a second pair of opposed sides, one side of said first pair of opposed sides having an ink supply opening for supplying ink to said ink jet recording head; and an ink retaining member, in said casing, for retaining ink;

wherein said ink retaining member is compressed in said casing so that a compression ratio A of said ink retaining member between said first pair of opposed sides is greater than a compression ratio B between said second pair of opposed sides and so that $1.1 \leqq A \leqq 1.6$.

2. An ink container according to claim 1, wherein the compression ratio B is $1.0 \leqq B \leqq 1.4$.

3. An ink container according to claim 1, wherein the compression ratio A is $1.1 \leqq A \leqq 1.4$, and the compression ratio B is $1.0 \leqq B \leqq 1.2$.

4. An ink container according to claim 1, wherein said casing has an internal surface, said ink retaining member has sides corresponding to respective sides of said casing, and a contact area of said ink retaining member relative to said internal surface except at the first pair of opposed sides is not less than 15% of a surface area of sides of said ink retaining member except at sides corresponding to the first pair of opposed sides.

5. An ink container according to claim 1, wherein said first pair of opposed sides are provided in sides of said hexahedron casing having edges other than a longest edge of said hexahedron casing.

6. An ink container according to claim 1, wherein said casing and said ink retaining member each is generally a rectangular parallelepiped, and wherein said ink supply opening is provided at a side having a smallest area.

7. An ink container according to claim 1, wherein said ink retaining member is heat-compressed at two sides of said rectangular parallelepiped.

8. An ink container according to claim 6, wherein said ink retaining member is heat-compressed at sides corresponding to sides other than the first pair of opposed sides.

* * * * *

UNITED STATES PATENT AND TRADEMARK OFFICE

CERTIFICATE OF CORRECTION

PATENT NO. : 5,852,457

DATED : December 22, 1998

INVENTOR(S) : Yasuo Kotaki, Masanori Takenouchi, Hideo Saikawa, Hisashi Yamamoto, and Yuji Hamasaki It is certified that error appears in the above-identified patent and that said Letters Patent is hereby corrected as shown below:

COLUMN 4

Line 9, change "$H_3$" to --$H_1$--;

Line 11, change "$L_1/L_0$" to --$L_0/L_1$--;

Line 12, delete "[A]"; and

Line 13, change "$H_1/H_0$=B" to --$H_0/H_1$=B--.

COLUMN 8

Line 35, change "41" to --41,--;

Line 39, change "V6=70" to --U6=70--; and

Line 67, change "they" to --that--.

Signed and Sealed this

Seventh Day of December, 1999

*Attest:*

*Attesting Officer*

Q. TODD DICKINSON

*Acting Commissioner of Patents and Trademarks*